US005509485A

United States Patent [19]

Almagro

[11] Patent Number: 5,509,485

[45] Date of Patent: Apr. 23, 1996

[54] FIRE SUPPRESSANT

[76] Inventor: Guillermo Almagro, 5414 Jersey Ave. S., Gulfport, Fla. 33707

[21] Appl. No.: 206,524

[22] Filed: Mar. 4, 1994

[51] Int. Cl.[6] ..... A62C 1/00

[52] U.S. Cl. ..... 169/46

[58] Field of Search ..... 169/9, 44, 45, 169/46, 47, 48

[56] References Cited

U.S. PATENT DOCUMENTS

| | | | |
|---|---|---|---|
| 3,976,580 | 8/1976 | Kaminstein et al. | 169/47 |
| 3,985,658 | 10/1976 | Riley et al. | 169/47 |
| 4,076,862 | 2/1978 | Kobeski et al. | 427/136 |
| 4,101,485 | 7/1978 | Brooks et al. | 260/29.4 |
| 4,176,071 | 11/1979 | Crouch | 169/45 |
| 4,197,913 | 4/1980 | Korenowski | 169/45 |
| 4,865,761 | 9/1989 | Mandel et al. | 169/44 |
| 5,132,030 | 7/1992 | Marx | 169/44 |

*Primary Examiner*—Stephen Avila
*Attorney, Agent, or Firm*—Lowe, Price, LeBlanc & Becker

[57] ABSTRACT

A fire suppressant composition consisting of a slurry of clay slime or sewage sludge is used to extinguish fires in building structures or forest fires.

6 Claims, No Drawings

FIRE SUPPRESSANT

BACKGROUND OF INVENTION

This invention relates to a material used to extinguish forest fires as well as high temperature fires in building structures, Background and description. In burning wood fires, the reaction between the water and carbon in wood produces water gas—a mixture of carbon monoxide and hydrogen—both substances being combustible. When a building catches fire and the temperature rises rapidly it can be controlled by using large volumes of water to bring the temperature below its kindling temperature, and at the same time quench the water gas reaction.

In some instances like forest fires where water is insufficient, high ambient temperatures during summer fanned by strong winds, it is almost impossible to control the spread of the fire. Sometimes a dry chemical-suppressant is used.

In the aerial application of liquid fire suppressant materials it has been found that these substances tend to atomize when dropped from substantial elevations. On the other hand, materials of high viscosity such as clay slimes tend to resist atomization upon descent to target areas.

The colloidal behavior of certain clays such as those produced in the beneficiation of phosphate ore in Florida commonly called "slimes" appears to effectively control or extinguish these fires.

The mining of phosphate ore in Central Florida is done by an open-pit method whereby the overburden is stripped to expose the phosphate ore called "matrix". The thickness of the matrix varies from one to fifty feet and consist essentially of ⅓ phosphate ore, ⅓ sand and ⅓ clay. The matrix is mined by a walking electrical dragline and the ore is hydraulically transported from the mining site to the beneficiation plant. The matrix is initially sized and washed to produce a ¾ inch to +16 mesh (Tyler mesh) of pebble product. The −16 mesh material is then subjected to a desliming operation to remove most of the −150 mesh waste material.

The suspension of −150 mesh waste slime is then transferred to a settling pond built in a mined out area. The solids slowly settle to produce an upper layer of clear water which is recycled back to the plant for further use. The composition of the slimes vary according to the mineralogical composition of the matrix from which it was mined. In Central Florida these consist essentially of montmorillonite and attapulgite together with some other minerals such as flourspar, quartz, and flourapatite, etc. The montmorillonite and attapulgite which are known for their water holding capacity and colloidal behavior contribute to the slow settling property of the slimes. Slimes that are transported to the impounding area contain approximately 1.5 to 3.5% solids. Over time the concentration of the slimes will attain steady state of about 25 per cent solids after several years of storage. It has been estimated that there are more than 1.5 billion tons of phosphatic clay slime solids stored in these dams. The storage of these slimes poses an environmental problem should the dams break and flood the surrounding areas with clay slimes. Furthermore, considerable amount of water that is stored in these dams are practically unusable.

SUMMARY OF THE INVENTION

This invention is based on the discovery of a method of extinguishing a fire using a finely divided material including colloidal argillaceous substance such as clay slimes or colloidal sewage sludge. In accordance with this invention, the rapid extinguishing property of the clay slimes is brought about by the cooling effect of water which when applied on the fire causes the water to vaporize and leave a residual coating of the clay on the burning material thereby shutting off the supply of oxygen to the burning material. The residual clay coating being non-combustible prevents the burning material from further accelerating the burning process. Unlike the water used, the clay slimes sticks tenaciously on the burning surface and does not react with the carbon.

It has been found that sewage sludge, a waste product of sewage treatment plants in municipalities or cities, exhibits the same fire retardant or fire suppressant properties as clay slimes. The sludge prior to filtration is chlorinated to destroy microorganisms and other harmful bacteria, and then treated with a cationic polymer to enhance its filterability. The final product from the filters come out as a black, gelatinous filter cake with a slight fetid odor. The solids concentration that is fed to the filters ranges from 1.0 to 3.0 per cent. The solids concentration that is obtained as filter cake ranges from 8 to 15 per cent.

It has been found that when the filter cake is spread on a piece of absorbent paper and dried to constant weight and then ignited the treated paper, does not burn when compared to an untreated paper used as control. This unexpected result shows that sewage sludge functions in the same manner as the clay slime does. Its fire retardant property might be attributed to the chlorine or cationic polymer used in the treatment of the sludge. Thus this sewage sludge may be used to put out fires, like forest fires or coal waste fires. A further advantage in using sewage sludge to control forest fires is its soil conditioning properties due to its organic matter content. It is also possible that this unusual behavior of sewage sludge might be attributed to the gelatinous character of the polymer used as filter aid as well as to the fine, colloidal behavior of the sludge itself. Thus, when sewage filter cake is thinned with water and applied as fire suppressant to put out fires, the water will first vaporize due to the heat and high temperature of the fire. The sludge residue would then be deposited on the surface of the burning material, thereby preventing the oxygen from combining with the burning carbon. The result is that combustion stops. And because the sludge has a gelatinous consistency, it will spread uniformly on the burning surface. Even at low concentrations, say at 3 per cent, would still be effective since the deposition of sludge will build up as more of it is applied.

The economic benefits of using phosphatic clay or sewage sludge would be tremendous, inasmuch as, these products are waste by-products and, therefore, have very little economic cost. Furthermore, insurance companies would benefit also since owners of damaged properties will have lesser claims and the result is that premiums would be reduced if these fire suppressants will used by fire fighters.

It is, therefore, the primary object of this invention to provide a method of extinguishing a fire by the use of an aqueous suspension of finely divided solids such as clay slimes or sewage sludge that exhibit colloidal behavior in water.

Another object of this invention is to provide a method of extinguishing a burning structure, such as buildings.

Still another object of this invention is to provide a method of extinguishing a forest fire.

A further object of this invention is to provide a method of preventing combustion of coal waste in coal mines.

These and further objects of this invention will become apparent or be described thereof herein proceeds.

DESCRIPTION OF THE INVENTION AND PREFERRED EMBODIMENTS

In a preferred embodiment, a suspension of phosphatic clay slime is prepared to a concentration of approximately 1.5 to 3.5 per cent solids. A 250 ml portion of this slurry was placed in a graduated cylinder to determine its settling property. Sixty gram samples of ponderosa pine needles were used in the fire test. The untreated sample was used as control. The test sample of ponderosa pine needles was dipped in the clay slimes suspension, then dried to constant weight.

EXAMPLE 1

A sample of the control was first used in the fire test. The sample was placed on top of a wire screen (½" square mesh), and then both ends were set on fire simultaneously using a lighted piece of paper, previously wetted with mineral spirits. The time of burning was determined. A similar piece of treated sample was also used in the fire test.

TABLE 1

RESULTS OF FIRE AND SETTLING TESTS

| Sample | Weight, g | Burning Time, min/sec | % Solids by weight | Settling Time 30 days |
|---|---|---|---|---|
| Control | 60 | 12 min 15 sec | 3.5 | A little but redispersed easily |
| Treated | 60 | Extinguished | 3.5 | A little but redispersed easily |

Burning of the treated sample was controlled easily by treatment with clay slimes. On the other hand, the untreated sample continued to burn until it was completely consumed. A little settling of the slurry was observed but was redispersed easily upon shaking.

EXAMPLE 2

A sample of sewage sludge at approximately 5% solids was also used to test its fire suppressant properties. The sludge was spread on an absorbent piece of paper and then dried to constant weight. Following the same test procedure described above, a fire test was conducted. The unttreated sample was first ignited using a piece of paper wetted with mineral spirits. Then the treated sample was ignited next. The results are shown below.

TABLE 2

RESULTS OF SEWAGE SLUDGE FIRE TESTS

| Sample | Burning Time, min. | % Solids |
|---|---|---|
| Control | 0.6 | 5 |
| Treated | Charred, failed to burn | 5 |

The sewage sludge burned to a char probably because of the cationic polymer used to treat the sludge. The ammonium cation in the polymer is considered also a fire retardant and, therefore, enhances the fire suppressant properties of the sludge.

What is claimed are:

1. A method of suppressing fires comprising applying an effective amount of a fire suppressant composition comprising a fine particulate gelatinous phosphatic clay slime to a flammable material environment, wherein the phosphatic clay slime is prepared to a concentration of about 1.5 to 3.5 percent solids.

2. The method of claim 1, wherein the phosphatic clay slime comprises montmorillonite and attapulgite.

3. The method of claim 1, wherein the clay slime is an aqueous slurry.

4. The method of claim 1, wherein the flammable material is burning.

5. The method of claim 1, wherein the flammable material is selected from the group consisting of forests, shrubbery or grass.

6. The method of claim 1, wherein the phosphatic clay slime is applied aerially.

* * * * *